US007581573B2

(12) United States Patent
Hu

(10) Patent No.: US 7,581,573 B2
(45) Date of Patent: Sep. 1, 2009

(54) ELECTRIC PENCIL SHARPENER

(75) Inventor: Jingyl Hu, Shenzhen (CN)

(73) Assignee: Ringsun (Shenzhen) Industrial Limited, Guangdong Province (CN)

( * ) Notice: Subject to any disclaimer, the term of this patent is extended or adjusted under 35 U.S.C. 154(b) by 255 days.

(21) Appl. No.: 11/602,252

(22) Filed: Nov. 21, 2006

(65) Prior Publication Data

US 2008/0060720 A1 Mar. 13, 2008

(30) Foreign Application Priority Data

Aug. 23, 2006 (CN) ..... 2006 1 0062271

(51) Int. Cl.
*B43L 23/00* (2006.01)

(52) U.S. Cl. ..... 144/28.72; 144/28.4; 144/28.5

(58) Field of Classification Search ..... 144/28.1, 144/28.4–28.9

See application file for complete search history.

(56) References Cited

U.S. PATENT DOCUMENTS 4,966,208 A * 10/1990 Uang ..... 144/28.72
5,394,613 A 3/1995 Ku ..... 30/454
6,065,514 A 5/2000 New ..... 144/28.5
6,470,929 B2 * 10/2002 Fregeolle ..... 144/28.72
6,886,614 B2 * 5/2005 Ricono et al. ..... 144/28.11
7,134,461 B2 * 11/2006 Takada ..... 144/28.72
7,240,703 B2 * 7/2007 Hu ..... 144/28.5

* cited by examiner

*Primary Examiner*—Shelley Self
(74) *Attorney, Agent, or Firm*—Jacobson Holman PLLC

(57) ABSTRACT

An electric pencil sharpener, comprises a base, a powering device, a feeding subassembly, a cutter subassembly and an adjusting subassembly. Two brackets (31, 32) are mounted on the base, standing face to face. Each of the brackets defines two guideways (35) therein. The powering device is attached to the base. The feeding subassembly comprises a feeding gear module and a pair of feeding rollers (23, 24). The feeding rollers are respectively supported in guideways between the brackets. The feeding gear module driven by the powering device makes one of feeding rollers to rotate therein. The adjusting subassembly encompasses the feeding rollers on the bracket. The adjusting subassembly pushes the feeding rollers to move along the guideways. With restriction of the guideways, the distance between the two feeding rollers alters so that pencils with different size can be automatically fed and processed.

9 Claims, 3 Drawing Sheets

ELECTRIC PENCIL SHARPENER

BACKGROUND OF THE INVENTION

1. Field of the Invention

The present invention generally relates to an office product, more particularly the present invention relates to a pencil sharpener capable of automatic sharpening and feeding different pencils with different sizes at one time.

2. Background of the Invention

As known to those who skilled in the art, numerous innovations for pencil sharpeners have been provided in the prior art that will be described hereafter. Even though these innovations may be suitable for the specific individual purposes to which they address. There are still many technical issues waiting to be solved.

A typical pencil sharpener is presented, U.S. Pat. No. 5,394,613 honored to Ku teaches a spring-driven pencil sharpener including a top cap having a top opening to receive a pencil and two corresponding slots to receive a fastening device including a couple of hollow frames, a housing which is constructed with a pair of coupling castings, each of which being accompanied by a lateral cover, for disposing a pencil blade set and a spring-driven powering device and the outline of the housing is preferably designed to cooperate with that of the cap to form an egg-like shape for being held comfortably as well as looking nice.

Another conventional pencil sharpener, U.S. Pat. No. 6,065,514 to New discloses a portable, handheld, sharpening device for sharpening a cosmetic pencil having an outer casing of hard material and an inner casing of soft wax-like cosmetic material. The device includes a plastic housing, a steel blade for removing the outer casing of material from the cosmetic pencil while providing a tip having a radius of no larger than about ⅛" to the inner core of cosmetic material and a motor coupled to the blade to rotate the blade that is connected to at least one battery. The device is small and lightweight so that it can conveniently be stored in a pocket or a purse.

In the related art, the blade can be driven by a motor to sharpen the pencil, however, the wood-cased pencil has to be hold and gradually fed into the sharpener. It is so inconvenient to manipulate the sharpening process. Moreover, in conventional pencil sharpeners, dealing with different pencils is feasible, and automatically sharpening pencils is feasible, but no traditional pencil sharpener possesses merits of both pencil automatic feeding and automatic sharpening process simultaneously.

Accordingly, an electric pencil sharpener having specific configuration that overcomes the above-mentioned problems is desired.

SUMMARY OF THE INVENTION

One object of the present invention is to provide an electric pencil sharpener capable of automatic sharpening and feeding different pencils with different sizes at one time, overcoming the shortcomings of the above mentioned prior art.

Further objects and features of the invention will be readily apparent to those skilled in the art from the following specification that includes the appended claims and drawings.

Briefly stated, to achieve the above objects in accordance with the purpose of the invention, in a preferred embodiment, an electric pencil sharpener comprises a base, a powering device, a feeding subassembly, a cutter subassembly and an adjusting subassembly. Two brackets are mounted on the base, standing on the base face to face. The two brackets defines a feeding space therebetween, each of the brackets defines two guideways therein. The powering device is attached to the base. The feeding subassembly comprises a feeding gear module and a pair of feeding rollers. The feeding rollers are respectively supported in corresponding guideways, spanning across the feeding space defined between the brackets. The feeding gear module driven by the powering device makes one of feeding rollers to rotate with the feeding gear module. The adjusting subassembly encompasses the pair of feeding rollers on the bracket. The adjusting subassembly comprises a cage, a cap covering one end portion of the cage, and two masses respectively jointing two end portions of shafts of the feeding rollers extending out from the feeding space through the guideways. A pillar is vertically mounted on each of the two masses. A path for riding the pillars is formed along the circumferential inner surface of the cage. An elastic member encompassing the feeding space is mounted between the cap and the two pillars to exert a reciprocating force on the pillars so that the pillars can be ridden in close proximity along the path in the cage. The adjusting subassembly pushes the pair of feeding rollers to move along the guideways simultaneously. With restriction of the guideways, the distance between the two feeding rollers alters so that pencils with different size can be processed.

Other objects, advantages and novel features of the present invention will be drawn from the following detailed description of a preferred embodiment of the present invention with the attached drawings, in which:

DETAILED DESCRIPTION OF THE INVENTION

Figure 1:
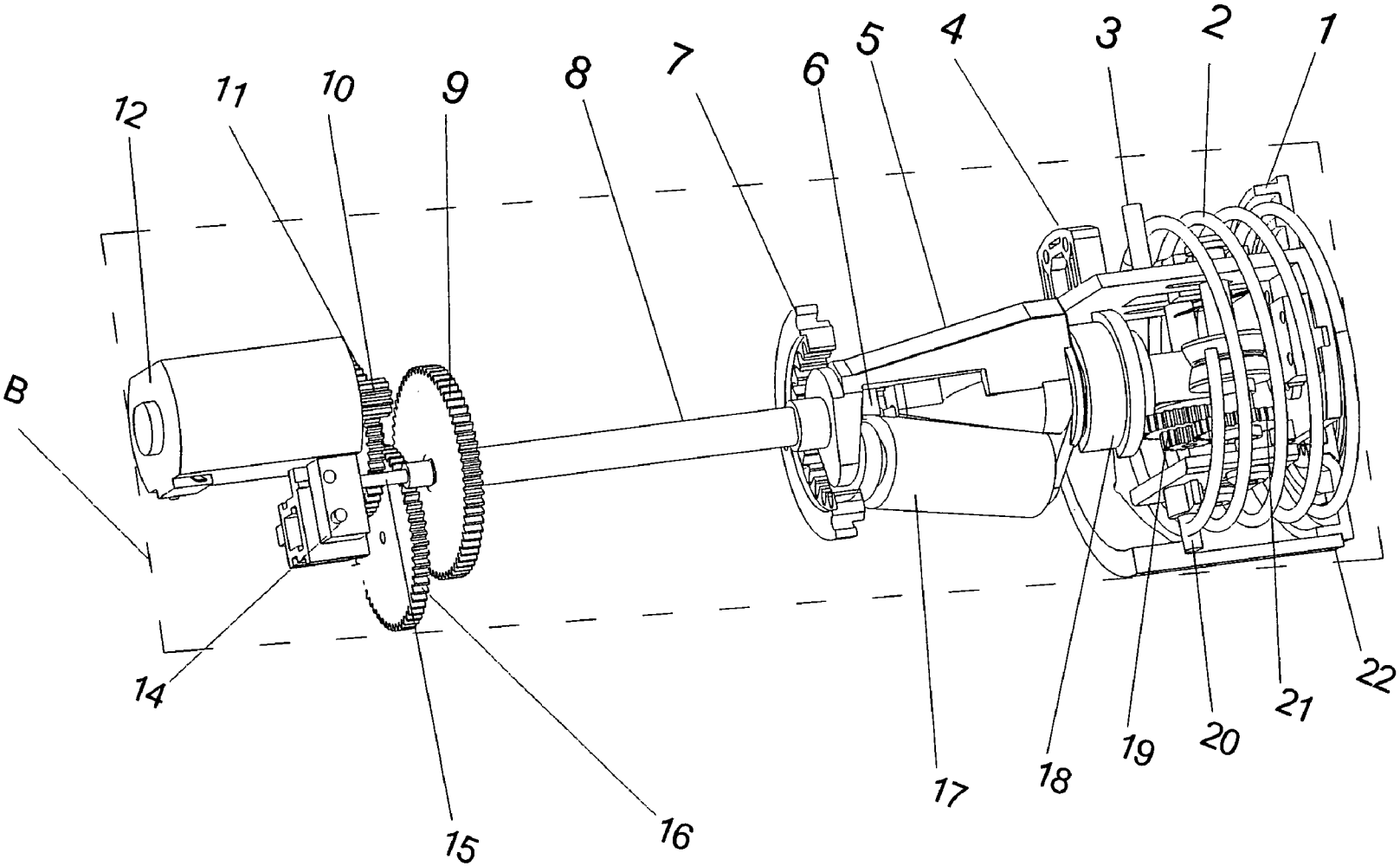
FIG. 1 is a perspective view of inner structures of a electric pencil sharpener in accordance with a preferred embodiment of the present invention, comprising two brackets, a powering device, a feeding subassembly, a cutter subassembly and an adjusting subassembly.

Throughout the drawings, the same reference numerals and characters, unless otherwise stated, are used to denote like features, elements, components or portions of the illustrated embodiments. Moreover, while the subject invention will now be described in detail with reference to the drawings, it is done so in connection with the illustrative embodiment. It is intended that changes and modifications can be made to the described embodiment without departing from the true scope and spirit of the subject invention as defined by the appended claims.

Figure 2:
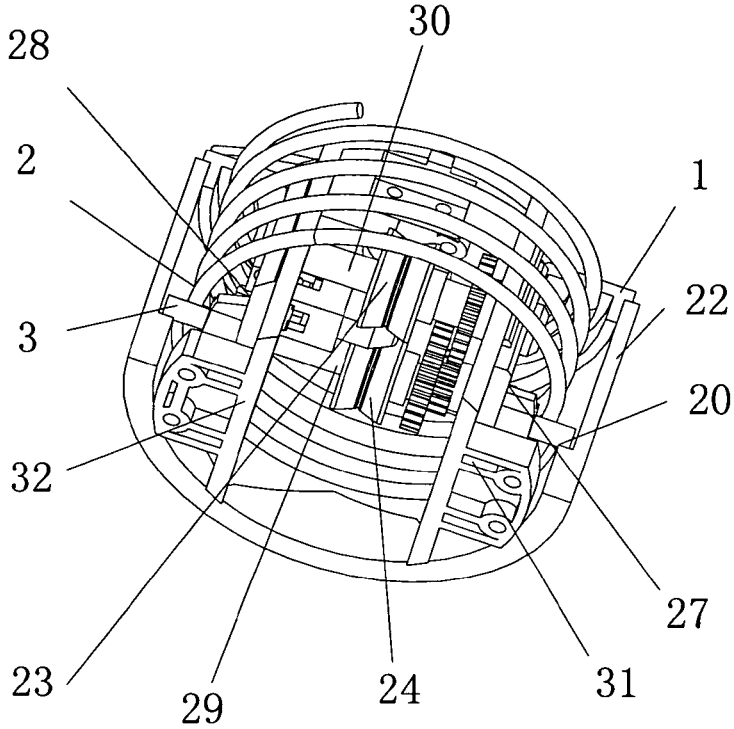
FIG. 2 is an assembled view of the adjusting subassembly of the electric pencil sharpener shown in FIG. 1.
Figure 3:
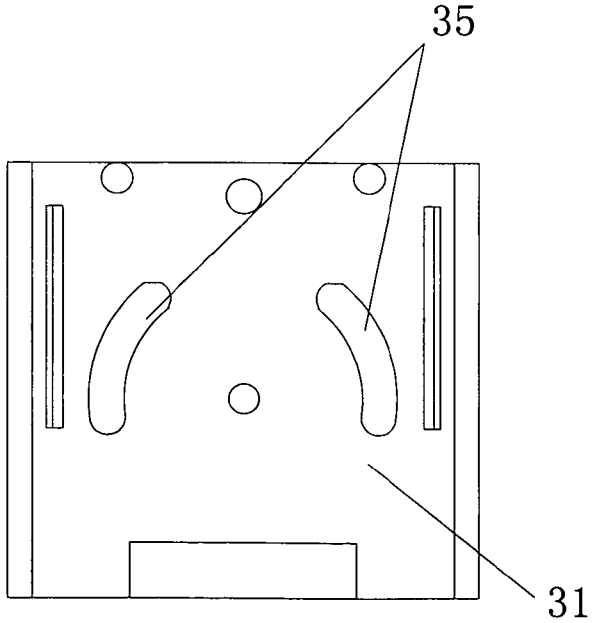
FIG. 3 is an enlarged view of the support bracket in FIG. 1, viewed from another aspect.

Referring to FIG. 1 to FIG. 3, an electric pencil sharpener in accordance with a preferred embodiment of the present invention includes a base (not shown in the drawings), a powering device, a cutter subassembly, a feeding subassembly, and an adjusting subassembly.

The base is constructed with traditional configuration. For this purpose, the base can be integrated with an external shell. Advantageously, the external shell forms a plurality of support surfaces to ensure proper positioning and alignment of the various subassemblies, in the x-, y- and z-directions. For easy assembly purpose, the external shell may include a first external shell and a second external shell attached to each other. The first external shell is mated with second external shell to define a substantially closed compartment, serving as the sole means of mounting the components mentioned supra in the compartment.

Two brackets 31, 32 are mounted on the base, standing thereon and defining a feeding space between two brackets 31, 32. Each of the brackets 31, 32 defines a pair of guideways 35 therein. The guideways 35 in each of the brackets 31, 32 are symmetrically defined so as to generate a synchronous route for the feeding subassembly.

The powering device is attached to the base, which comprises a motor 12 outputting rotation by a pinion 10 and a transmission device. The transmission device comprises a gear train, a drive shaft 8, a blade holder 5, and a crown gear 18. The gear train includes first gear 11 meshing with the pinion 10 of the motor 12, a second gear 16 and a third gear 9. The drive shaft 8, the blade holder 5, and the crown gear 18 are successively connected with one another, and capable of pivoting along with the third gear 9. The crown gear 18 defines a throughbore (not shown), and the throughbore is configured as an inlet for receiving a pencil to be processed.

The cutter subassembly comprises a helical blade 17 and the blade holder 5. The helical blade 17 revolves along with the blade holder 5. An internal gear 7 rested upon the base is in close proximity to the blade holder 5. The blade holder 5 forms a shaft (not shown). The helical blade 17 is set on the shaft forementioned, and a planet gear (not shown) is engaged with the helical blade 17 at one end thereof. The planet gear meshes the internal gear 7 on the base. The helical blade 17 revolves along with the blade holder 5, whilst the planet gear at the end of the helical blade 17 travels around the internal gear 7 so as to cause self-rotation of the helical blade 17, and the self-rotating helical blade 17 sharpens the pencil. Pencil sharpening continues until the pencil touches a sensor block 6 to trigger the motor 12 pivoting on a reversal direction and the pencil will be retreated from the cutter subassembly after being sharpened.

The feeding subassembly comprises a feeding gear module, a first feeding shaft 29, a second feeding shaft 30, a feeding roller 24 combining with the first feeding shaft 29, and a feeding roller 23 combining with the second feeding shaft 30. The feeding gear module comprises a duplicate gear 19 meshing with the crown gear 18 of the transmission device, and a feeding gear 21 meshing with the duplicate gear 19. The feeding rollers 23,24 together with the first and second feeding shafts 29, 30 are respectively supported on the brackets 31, 32 through corresponding guideways 35, spanning over the feeding space between the brackets 31, 32. The feeding gear 21 of the feeding gear module makes the feeding roller 30 to rotate along with the feeding gear 21, so that when the pencil is sandwiched between the two feeding rollers 23, 24, torque successive from the motor 12, gear train, drive shaft 8, blade holder 5, crown gear 18, duplicate gear 19, feeding gear 21 to the feeding shaft 30 drives the sandwiched pencil to go toward the cutter subassembly.

For different pencil sharpening purpose, distance between the two feeding shafts 29, 30 is adjustable, meanwhile value of the distance between the two feeding shafts 29, 30 can also determine the friction force between pencil and the feeding rollers 23,24.

Advantageously, the center line of the cutter subassembly is aligned with the center between the two feeding rollers 23, 24, so that the pencil to be processed after getting through the feeding rollers 23, 24, can directly goes into the cutter subassembly in sharpening position without additional adjustment.

Figure 4:
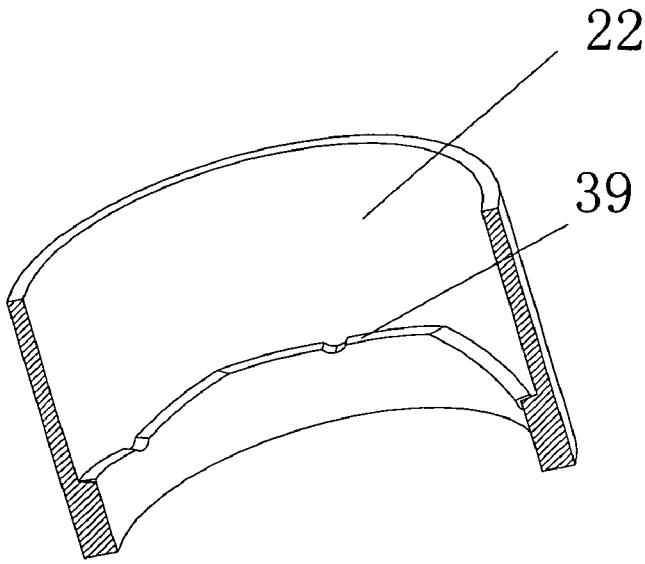
FIG. 4 is the section view of the cage shown in FIG. 1, viewed from another aspect.
Figure 5:
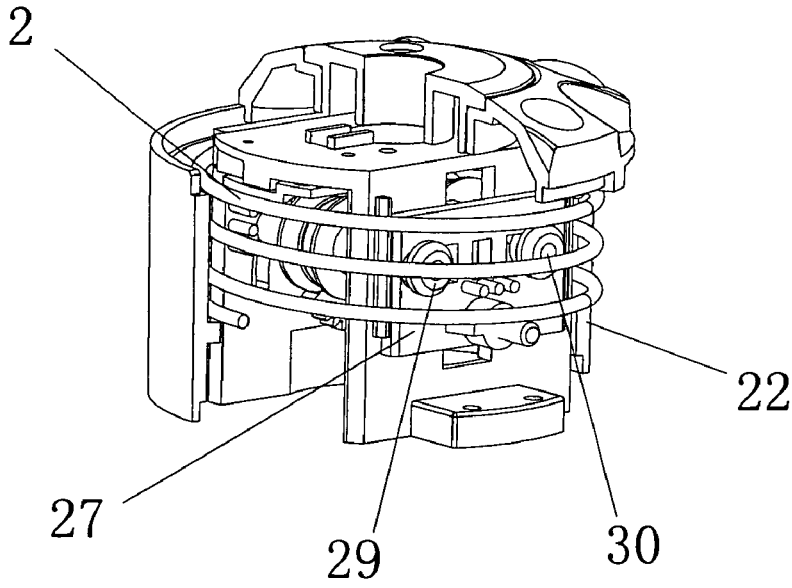
FIG. 5 is a partial view of the adjusting subassembly in FIG. 2, but viewed from another aspect.

Referring to FIG. 3 to FIG. 5, the guideways 35 in each of the brackets 31, 32 are symmetrically defined so as to generate a synchronous route for the feeding rollers 23, 24 of the feeding subassembly. On condition that both the feeding rollers 23, 24 goes upwards, the feeding rollers 23, 24 approach each other and the distance therebetween minishes, pencils with small size can be sharpened. While both the feeding rollers 23, 24 goes downwards, the feeding rollers 23, 24 depart from each other and the distance therebetween increases, pencils with large size can be sharpened (in FIG. 3).

The guideways 35 in each of the brackets 31, 32 are defined in a annular shape in that when both the feeding rollers 23, 24 goes upwards or downwards, the feeding gear 21 will mesh the feeding shaft 30 all along, to form a clear feeding path.

The adjusting subassembly encompasses the feeding rollers 23, 24 on the bracket 31, 32. Said adjusting subassembly comprises a cage 22, a cap 1 covering one end portion of the cage 22, and two masses 27, 28 respectively jointing two end portions of the feeding shaft 29, 30 extending out from the feeding space through the guideways 35. A pillar 3, 20 is mounted on each of the two masses 27, 28. The pillars 3, 20 are settled on a path 39 formed on the inner surface of the cage 22. The path 39 along the circumferential inner surface of the cage 22 is configured to ride the pillars 3, 20. The path 39 inside the cage 22 is symmetrical along the circumferential direction of the cage 22. An elastic member 2 encompassing the feeding space is mounted between the cap 1 and the two pillars 3, 20 to exert a reciprocating force on the pillars 3, 20 in order to ride the pillars 3, 20 in close proximity along the path in the cage. The elastic member 2 in the preferred embodiment of the present invention is a spring.

The adjusting subassembly pushes the feeding rollers 23, 24 to move along the guideways 35. With restriction of the guideways 35, the distance between the two feeding rollers 23, 24 alters so that pencils with different size can be processed.

The electric pencil sharpener further comprises a pencil quitting subassembly. The quitting subassembly comprises the sensor block 6, a rod 15, and a switch 14. After the pencil has been sharpened, it triggers the sensor block 6, then the sensor block 6 pushes the rod 15 getting through the drive shaft 8 to trigger the switch 14, finally the motor 12 rotates in a reversal direction.

The shafts distance adjusting process of the exemplary electric pencil sharpener of the present invention is listed as follows: rotate the cap 1, and the cage 22 engaged with the cap 1 rotating therealong. As the cage 22 rotates, the pillars 3, 20 parked on the path 39 begin to run along the path 39. When the pillars 3, 20 climb up to a peak of the path 39, the masses 27, 28 engaged with the feeding shafts 29, 30 will push the feeding shafts 29, 30 to move up along the guideways 35, at the same time, the elastic member 2 is compressed. When the pillars 3, 20 fall down to a trough of the path 39, the masses 27, 28 and the feeding shafts 29, 30 will get down along the guideways 35, meanwhile, the elastic member 2 is decompressed. On condition that both the feeding shafts 29, 30 goes upwards, the feeding rollers 23, 24 approach each other and the distance therebetween minishes, pencils with small size can be sharpened. While both the feeding shafts 29, 30 goes downwards, the feeding rollers 23, 24 depart from each other and the distance therebetween increases, pencils with large size can be sharpened.

While the present invention has been illustrated by the description of the preferred embodiment thereof, and while the preferred embodiment have been described in considerable detail, it is not intended to restrict or in any way limit the scope of the appended claims to such detail. Additional advantages and modifications within the spirit and scope of the present invention will readily appear to those skilled in the art. Therefore, the present invention is not limited to the specific details and illustrative examples shown and described.

I claim:

1. An electric pencil sharpener, comprising:

a base, two brackets mounted on the base, the two brackets defining a feeding space therebetween, each of the brackets defining two guideways therein;

a powering device, attached to the base;

a cutter subassembly, mounted in the base, driven by the powering device, adapted for sharpening a pencil;

a feeding subassembly mounted in the base, adapted to feed the pencil toward the cutter subassembly, driven by the powering device, comprising a feeding gear module and a pair of feeding rollers supported on the opposite brackets, the pair of feeding rollers located in the feeding space, the feeding gear module driven by the powering device turning at least one feeding roller to rotate therein thereby the pair of feeding rollers sandwiching the pencil and feeding the pencil by friction; and an adjusting subassembly encompassing the pair of feeding rollers on the bracket, wherein the adjusting subassembly pushes the pair of feeding rollers to move along the guideways simultaneously, with restriction of the guideways, the distance between the pair of feeding rollers alters to sharpen different pencil, meanwhile the at least one feeding roller keeps being engaged with the feeding gear module.

2. The electric pencil sharpener as described in claim 1, wherein the adjusting subassembly comprises a cage mounted inside the base, a cap covering one end portion of the cage rotated to change distance between the pair of feeding rollers, and two masses respectively jointing two end portions of shafts of the feeding rollers extending out from the feeding space through the guideways, a pillar is mounted on each of the two masses, a path for riding the pillars is formed along the circumferential inner surface of the cage, an elastic member encompassing the feeding space is mounted between the cap and the two pillars to exert a reciprocating force on the pillars in order to ride the pillars in close proximity along the path in the cage.

3. The electric pencil sharpener as described in claim 2, wherein the guideways in each of the brackets are symmetrical, the path inside the cage is symmetrical along the circumferential direction of the cage.

4. The electric pencil sharpener as described in claim 1, wherein the cutter subassembly comprises a helical blade driven by the powering device and a blade support, for easy feeding the pencil, center line of the cutter subassembly is aligned with center between the pair of feeding rollers.

5. The electric pencil sharpener as described in claim 1, further comprising a pencil quitting subassembly, the quitting subassembly comprising a sensor block triggered by the pencil after being sharpened, a rod pushed by the sensor block, and a switch triggered by the rod setting the motor rotate in a reversal direction.

6. An electric pencil sharpener, comprising:

a base, two brackets are mounted on the base, the two brackets defining a feeding space therebetween, each of the brackets defining two guideways therein;

a powering device, attached to the base;

a cutter subassembly, mounted in the base, adapted for sharpening a pencil, the cutter subassembly comprising a helical blade driven by the powering device; and;

a feeding subassembly mounted in the base, adapted to feed the pencil toward the cutter subassembly, driven by the powering device, comprising a feeding gear module and a pair of feeding rollers supported on the opposite brackets, the pair of feeding rollers located in the feeding space, the feeding gear module driven by the powering device turning at least one feeding roller to rotate therein thereby the pair of feeding rollers sandwiching the pencil and feeding the pencil by friction;

an adjusting subassembly engaged with the feeding subassembly, the adjusting subassembly pushing the pair of feeding rollers to move along the guideways, with restriction of the guideways, changing distance between the two feeding rollers, thereby the feeding rollers capable of sandwiching different pencil and feeding toward the cutter subassembly;

wherein center line of the cutter subassembly is aligned with center between the pair of feeding rollers to form a smooth feeding path, at least one feeding roller keeps being engaged with the feeding gear module.

7. The electric pencil sharpener as described in claim 6, wherein the adjusting subassembly comprises a cage mounted inside the base, a cap covering one end portion of the cage rotated to change distance between the pair of feeding rollers, and two masses respectively jointing two end portions of shafts of the feeding rollers extending out from the feeding space through the guideways, a pillar is mounted on each of the two masses, a path for riding the pillars is formed along the circumferential inner surface of the cage, an elastic member encompassing the feeding space is mounted between the cap and the two pillars to exert a reciprocating force on the pillars in order to ride the pillars in close proximity along the path in the cage.

8. The electric pencil sharpener as described in claim 7, wherein the guideways in each of the brackets are symmetrical, the path inside the cage is symmetrical along the circumferential direction of the cage.

9. The electric pencil sharpener as described in claim 6, further comprising a pencil quitting subassembly, the quitting subassembly comprising a sensor block triggered by the pencil after being sharpened, a rod pushed by the sensor block, and a switch triggered by the rod setting the motor rotate in a reversal direction.

* * * * *